United States Patent [19]

Rigby

[11] Patent Number: 4,836,438

[45] Date of Patent: Jun. 6, 1989

[54] OVENABLE CARTON WITH HANDLES

[75] Inventor: William R. Rigby, Elton, Md.

[73] Assignee: Westvaco Corporation, New York, N.Y.

[21] Appl. No.: 255,866

[22] Filed: Oct. 11, 1988

[51] Int. Cl.[4] ..... B65D 5/46

[52] U.S. Cl. ..... 229/52 B; 206/621; 206/625; 206/631.1

[58] Field of Search ..... 229/52 B; 206/621, 625, 206/631.1

[56] References Cited

U.S. PATENT DOCUMENTS

| | | | |
|---|---|---|---|
| 3,294,311 | 12/1966 | Chidsey, Jr. | 206/621 X |
| 3,946,937 | 3/1976 | Forbes, Jr. et al. | 206/621 |
| 4,361,236 | 11/1982 | Lavery | 206/625 X |
| 4,746,019 | 5/1988 | Prater | 206/625 |

FOREIGN PATENT DOCUMENTS

| | | | |
|---|---|---|---|
| 1542461 | 3/1979 | United Kingdom | 206/625 |

*Primary Examiner*—Stephen Marcus
*Assistant Examiner*—Kathryn M. Stemann

[57] ABSTRACT

A microwave ovenable package is disclosed including a top structure which incorporates therein a pair of handle elements useful for removing the package from the microwave oven. In the preferred embodiment, the top structure includes integral side walls which are adhered to the sides of the package. The integral side walls are connected to the top structure along cut/scored lines which delaminate upon opening the top. The portions of the side walls which remain attached to the package can then be folded outwardly to produce handles for removing the package from the microwave oven.

9 Claims, 2 Drawing Sheets

10
20
11
30
21
12
24
13
25
15
14
22
23
32
16
35
34
31
36
26
40
39
17
38
41
27
18
37
33
29
28
42
19

OVENABLE CARTON WITH HANDLES

BACKGROUND OF INVENTION

The present invention relates to a paperboard carton structure and more particularly to a microwave ovenable package with handle elements useful for removing the hot package from a microwave oven.

Cartons prepared from paperboard for use in microwave ovens are often heated to elevated temperatures during the cooking process. These cartons generally remain too hot to touch even after the cooking process. The steam and cooking vapors generated by the relatively high temperatures encountered in cooking food products in the microwave may be removed by automatic or manual venting means, but the carton itself generally still remains hot. This makes it difficult to remove the carton from the microwave so that the cooked food products may be served in a timely fashion.

Thus, it is a general object of the present invention to provide an effective means for removing a normally too hot to touch paperboard carton from a microwave oven after cooking. More particularly, it is a specific object of the present invention to provide handles on a paperboard carton which enables the carton to be removed from the oven in a timely fashion after the cooking process.

SUMMARY OF THE INVENTION

In order to achieve the foregoing objectives, the present invention contemplates the inclusion of handle elements located at each side of the paperboard carton which may be grasphed when removing the carton from the microwave oven after the cooking process. The handles are preferably not exposed until they are needed. For this purpose, the handles are incorporated in the normal structure of the carton for release when the carton is opened. In a preferred embodiment, the carton has a top structure which incorporates therein a pair of handle elements. The top structure includes integral side walls which overlap and are adhered to the side walls of the cooking tray. The integral side walls are connected to the top structure along cut/score lines which delaminate when the top is removed. This leaves portions of the side walls of the top structure adhered to the cooking tray so that they can readily be folded outwardly to provide convenient handle elements for handling the cooking tray.

In the case where the lid is completely removed before cooking, the handles are available for handling the carton both before and after cooking. If the cooking directions specify a sealed cook-in method, the handles can be released for use after the cooking process and before the carton is removed from the microwave oven.

The manner in which the foregoing objectives and advantages of the present invention may best be achieved will be more fully understood from a consideration of the following detailed description of a preferred embodiment of the present invention, taken in light of the accompanying drawing.

DETAILED DESCRIPTION

Figure 1:
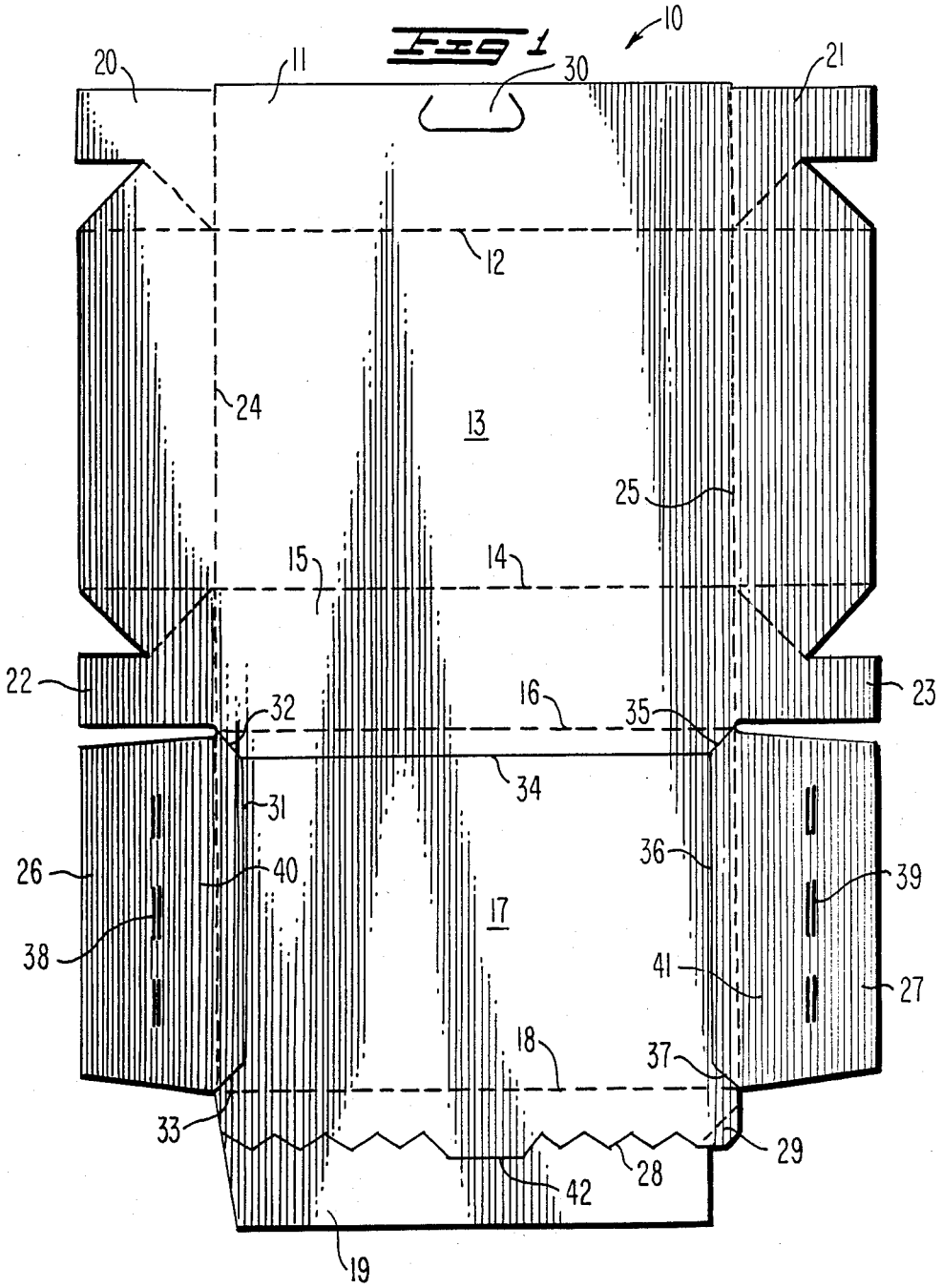
FIG. 1 is a top plan view of a typical blank structure incorporating the details of the invention.
Figure 2:
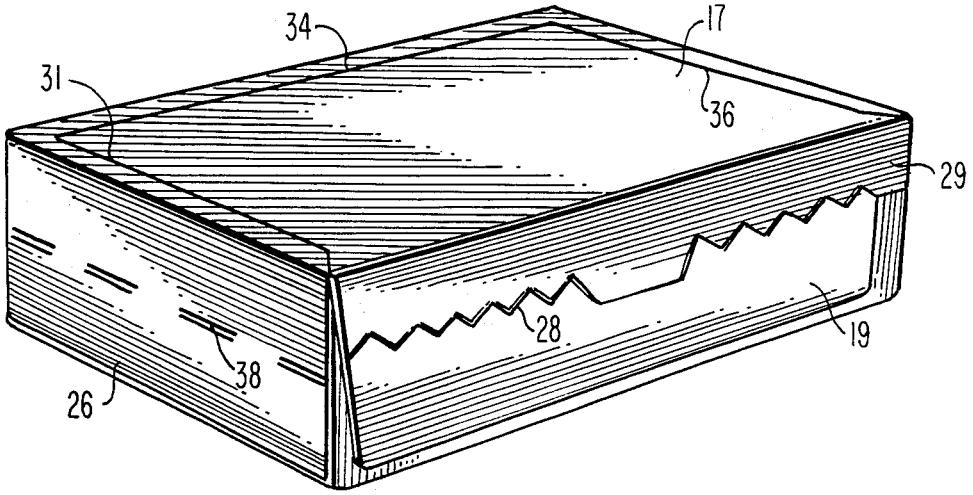
FIG. 2 is a perspective view of a sealed carton prepared from the blank of FIG. 1; and, FIG. 3 is a front elevational view of the carton of FIG. 2 opened to release the handle elements.

With reference to the drawing, and particularly FIG. 2, a typical ovenware paperboard carton for the present invention is illustrated as a simple rectangular carton of minor depth that includes a cooking tray and a top structure with integral side and front walls. The side and front walls overlap corresponding walls of the cooking tray and are adhered thereto after the cooking tray is filled with a food product to produce a sealed cook-in carton. Generally such cartons include cooking trays with gusseted corners to render the trays leak proof. A typical blank for forming such a carton is shown in FIG. 1.

Referring now to FIG. 1, the blank 10 comprises a tray portion including front wall 11, bottom panel 13 and rear wall 15 separated from one another by score lines 12 and 14. At each side of bottom panel 13 are tray side walls separated from the bottom panel by score lines 24 and 25. At each corner of the cooking tray are gusseted corner panels shown generally by the reference characters 20, 21, 22 and 23. Meanwhile, the top portion of the blank 10 consists of a top structure comprising a lid panel 17, front wall 19 separated from lid panel 17 by a score line 18 and a pair of side wall flaps 26, 27 separated from lid panel 17 by score lines 24, 25. The front wall 19 may include a typical opening means shown for example as a single line of tear 28 and a lift tab 29. The single line of tear 28 is illustrated as including a carton reclosure tab 42 which may cooperate with the slot 30 in the tray front wall to reclose the carton after opening if desired.

The lid panel 17 and top structure side wall flaps 26, 27 combine to provide the lifting handles for the carton. For this purpose, the lid panel 17 includes microcut lines 31, 34 and 36 that do not penetrate the entire thickness of the paperboard spaced inwardly from the score lines 24, 16 and 25 to provide a delamination area therebetween. At the corners of the lid panel 17, additional cut lines may be added as shown at 32, 33, 35 and 37 to produce a smooth and uninterrupted operation of the delamination step. Meanwhile the top structure side walls 26, 27 include interrupted score lines 38, 39 to aid in forming the carton handles shown in detail as 40, 41, in FIG. 3.

Figure 3:
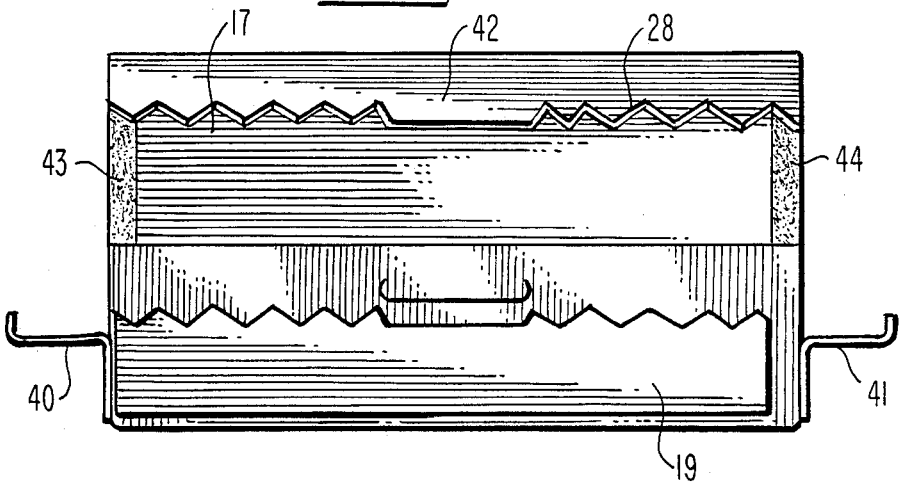

In operation, the carton functions as follows. After the tray portion is formed, the carton is filled with food product and closed by folding the lid panel 17 over the tray. At this time, the top structure side walls 26, 27 are adhered to the side walls of the tray portion below the interrupted score lines 38, 39 and the top structure front wall 9 is adhered to the front wall of the tray portion below the single line of tear 28. This produces a sealed cook-in carton typical of many microwaveable packages. However, by including the microcuts 31, 32, 33, 34, 35, 36 and 37 as shown, in the lid panel 17, either all or a portion of the top structure can be removed from the package to release the lifting handles 40, 41 of the present invention. FIG. 3 shows the lid panel 17 partially removed from the carton. This step is accomplished by tearing the front wall 19 along tear line 28, and lifting the lid causing delamination of the paperboard structure in the areas 43, 44 between the fold lines 24, 25 and microcuts 31, 36 of the top structure. This action releases the lifting handles 40, 41, which in effect comprises the free upper portions of side walls 26, 27 which otherwise remain attached to the tray portion of the package.

The location of the microcut lines 31, 34 and 36 with respect to fold lines 24, 16 and 25 in the top structure is subject to variation depending upon the weight of the paperboard material, the size of the lid structure and the type of food product packaged. These lines should be fat enough apart to prevent inadvertent tear when the carton is formed, but close enough to produce delamination of the top structure as shown at 43, 44 in FIG. 3 when the lid is raised. Also, it is contemplated by the present invention that the delamination areas may be created by parallel and spaced apart microcuts located on the inner and outer surfaces of the top structure. In such a case, the delamination areas would not necessarily have to be located at the edges of the lid panel 17. The only essential feature of the present invention is that the top structure include integral side walls, a portion of which become adhered to the side walls of the cooking tray, since it is the top structure side walls which ultimately constitute the lifting haldes for the carton. Beyond this feature, it will be appreciated that other modifications of the invention may be resorted to, within the scope of the claims appended hereto.

What is claimed is:

1. A package prepared from paperboard for food products and consisting essentially of a substantially polygonal shaped tray portion for supporting and confining the food products, said tray portion comprising a bottom panel with upstanding side walls and corner panels, and a top structure of substantially the same shape as the tray portion for convering the stray portion, said top structure comprising a lid panel foldably attached to one of the side walls of said tray portion along a score line and including integral side walls which are foldably attached to the lid panel along additional score lines for overlapping the side walls of the tray portion, means for adhering portions of the top structure side walls that are remote from their score lines to the corresponding side walls of the tray portion and means in the lide panel for separating unadhered portions of at least two opposed side walls of the top structure from the lid panel to provide handle elements formed by the unadhered portions of the two opposed side walls of the top structure for said package.

2. The package of claim 1 wherein said tray portion is substantially rectangular in shape and the side walls of said top structure comprise a front wall and a pair of opposed side walls.

3. The package of claim 2 wherein the top structure front wall comprises two portions, an upper portion which is foldably attached to the lid panel along a front score line and a lower portion which is adhered to the corresponding side wall of the tray portion and which is connected to the upper portion along at least one tear line.

4. The package of claim 3 wherein the opposed side walls of said top structure each comprise two portions, upper portions which are foldably attached to the lid panel along second and third score lines and lower portions which are adhered to the corresponding side walls of the tray portion, and lower portions connected to adjacent upper portions along interrupted score lines, wherein the upper portions of the opposed side walls of the top structure comprise the handle elements of the package when they are separated from the lid panel.

5. The package of claim 4 wherein the means in the lid panel of the top structure for separating the upper portions of the opposed side walls of the top structure from the lid panel comprise microcuts located on an inside surface of the lid panel, parallel to and spaced a distance from the second and third score lines sufficient to produce a delamination of the top structure in those areas when the lid panel is raised.

6. The package of claim 5 wherein an additional microcut is located on the inside surface of the lid panel adjacent to the score line between the lid panel and one of the side walls of the tray portion to produce a delamination of the top structure in the area when the lid panel is removed.

7. A paperboard blank for making a carton with handles suitable for use in a microwave oven comprising:

(a) a tray portion bottom panel of substantially rectangular shape having side walls foldably attached to two opposed sides thereof and front and rear walls foldably attached to the remaining opposed sides thereof, and including gusset panels foldably attached between the ends of the respective side, front and rear walls;

(b) a top structure lid panel of substantially rectangular shape having one edge thereof foldably attached to the rear wall of the bottom panel of the tray portion, a pair of side walls foldably attached to opposed sides of said lid panel, and a front wall foldably attached to the remaining edge of said lid panel; and, (c) means in the front wall of the top structure forming a tearable opening for the carton formed from the blank, and means in the lid panel of the top structure for separating the side walls of the top structure from the lid panel to form handles for the carton and for separating the lid panel from the rear wall of the tray portion.

8. The blank of claim 7 wherein the means in the front wall of the top structure for opening the carton comprises a tear strip formed from at least one tear line which separates the front wall into two portions.

9. The blank of claim 8 wherein the means in the lid panel for separating the side walls from the lid panel and the lid panel from the rear wall of the tray portion comprises microcut lines located on the inside surface of the blank, parallel to and spaced a distance from the foldable connections between the lid panel, its side walls and the rear wall of the tray portion, sufficient to provide areas of delamination in the lid panel.

* * * * *